US011389689B2

(12) United States Patent
Leipheimer

(10) Patent No.: US 11,389,689 B2
(45) Date of Patent: Jul. 19, 2022

(54) WEIGHT RATIO ARRANGEMENT FOR A WEIGHT MACHINE

(71) Applicant: Specialty Fitness Systems, LLC, Franklin, PA (US)

(72) Inventor: Jerry K. Leipheimer, Sharpsville, PA (US)

(73) Assignee: Specialty Fitness Systems, LLC, Franklin, PA (US)

( * ) Notice: Subject to any disclaimer, the term of this patent is extended or adjusted under 35 U.S.C. 154(b) by 104 days.

(21) Appl. No.: 16/686,741

(22) Filed: Nov. 18, 2019

(65) Prior Publication Data

US 2020/0155889 A1 May 21, 2020

Related U.S. Application Data

(60) Provisional application No. 62/769,172, filed on Nov. 19, 2018.

(51) Int. Cl.
*A63B 21/00* (2006.01)
*A63B 21/062* (2006.01)

(52) U.S. Cl.
CPC ..... *A63B 21/156* (2013.01); *A63B 21/00065* (2013.01); *A63B 21/00069* (2013.01); *A63B 21/0626* (2015.10); *A63B 2225/09* (2013.01)

(58) Field of Classification Search
CPC ..... A63B 21/156; A63B 21/0626; A63B 21/00069; A63B 21/00065; A63B 2225/09; A63B 21/0628; A63B 2208/0238; A63B 21/4035; A63B 21/4043; A63B 2225/10
See application file for complete search history.

(56) References Cited

U.S. PATENT DOCUMENTS

| | | | |
|---|---|---|---|
| 3,438,627 | A | 4/1969 | La Lanne |
| 4,154,441 | A | 5/1979 | Gajda |
| 4,402,504 | A | 9/1983 | Christian |
| 4,603,855 | A | 8/1986 | Sebelle |
| 4,640,268 | A | 2/1987 | Roberts |
| 5,102,122 | A | 4/1992 | Piane, Jr. et al. |
| 5,725,459 | A | 3/1998 | Rexach |
| 6,165,110 | A | 12/2000 | Gajda |

(Continued)

FOREIGN PATENT DOCUMENTS

| | | | |
|---|---|---|---|
| CN | 108136246 | A | 6/2018 |
| WO | 2018089624 | A1 | 5/2018 |

*Primary Examiner* — Andrew S Lo
(74) *Attorney, Agent, or Firm* — The Webb Law Firm

(57) ABSTRACT

An exercise machine may include a support frame; at least one weight rack configured to receive added weight; and a weight ratio arrangement engaged with the support frame, the at least one weight rack, and a first attachment. The weight ratio arrangement may include an exercise cable having a first end connected to the first attachment and a second end connected to a portion of the machine; at least two movable pulley blocks, each including at least one pulley, wherein the at least one weight rack is attached to and configured to move with one of the at least two movable pulley blocks; and a locking mechanism movable between a locked position in which only one movable pulley block is movable and an unlocked position in which the two movable pulley blocks are movable. The exercise cable may be operatively connected to the at least two movable pulley blocks.

20 Claims, 12 Drawing Sheets

(56) References Cited

U.S. PATENT DOCUMENTS 6,217,493 B1 4/2001 Spletzer
6,338,701 B1 1/2002 Webber
6,394,935 B1 5/2002 Lake
6,447,430 B1 * 9/2002 Webb ..... A63B 21/154 482/93
6,685,600 B1 2/2004 Ullman
6,770,015 B2 8/2004 Simonson
7,331,912 B2 2/2008 Keiser et al.
7,335,141 B2 2/2008 Piane, Jr.
7,503,882 B2 3/2009 Sechrest et al.
7,553,264 B2 * 6/2009 Carter ..... A63B 21/154 482/102
7,654,942 B1 2/2010 Batea
7,758,478 B2 7/2010 Golesh et al.
8,172,733 B1 * 5/2012 Batea ..... A63B 21/156 482/99
8,246,524 B2 8/2012 Castillo
8,465,400 B1 * 6/2013 Batea ..... A63B 23/1209 482/99
8,968,164 B2 3/2015 Giannelli
9,050,496 B2 6/2015 Towley, III et al.
9,821,188 B2 11/2017 Dwork et al.
2001/0034290 A1 10/2001 Tolles
2002/0091043 A1 7/2002 Rexach
2003/0060345 A1 3/2003 Piane, Jr.
2003/0069112 A1 * 4/2003 Williams ..... A63B 21/156 482/101
2004/0018920 A1 1/2004 Simonson
2007/0042878 A1 2/2007 Lundquist et al.
2008/0242520 A1 10/2008 Hubbard
2008/0287270 A1 11/2008 Carter
2008/0300116 A1 12/2008 Eder
2010/0267527 A1 * 10/2010 Luquette ..... A63B 21/0552 482/94
2011/0230315 A1 9/2011 Castillo
2013/0065737 A1 3/2013 Habing
2013/0296144 A1 * 11/2013 Gvoich ..... A63B 21/4043 482/102
2013/0303346 A1 11/2013 Barker
2013/0337982 A1 12/2013 Williams
2014/0121071 A1 * 5/2014 Strom ..... A63B 21/156 482/99
2014/0296037 A1 * 10/2014 Razzaq ..... A63B 22/0605 482/54

* cited by examiner

WEIGHT RATIO ARRANGEMENT FOR A WEIGHT MACHINE

BACKGROUND OF THE INVENTION

Field of the Invention

This disclosure relates generally to exercise or weight machines and, more particularly, to a weight ratio arrangement that allows a user to vary a mechanical advantage provided by traditional pulley arrangements on the exercise or weight machines.

Description of Related Art

Various exercise machines for strength training and conditioning have been developed including machines that utilize a weight stack and pulley arrangement to provide resistance to an exercising motion by a user. A conventional exercise machine has a frame, a load, or some type of arrangement for providing resistance mounted on the frame, and multiple exercise stations that are connected to the load. Typically, pulleys and cables are used to connect the load to the exercise stations. The pulleys and cables provide a mechanical advantage to a user using the exercise station. The mechanical advantage provided can be positive, negative, or neutral.

A conventional cable and pulley arrangement uses a first cable connected at a first end to the load or weight stack and at a second end to a first pulley. A second cable may be connected at a first end to a first exercise station. A second end of the second cable may engage a second pulley, then engage the first pulley, then a third pulley before finally being fixed to the frame. This pulley configuration allows the user to provide a force of 50% of the load or weight stack to lift the load or weight stack. The mechanical advantage in this pulley and cable arrangement is in a ratio of 2:1. The addition or subtraction of pulleys alters the mechanical advantage experienced by the user.

Many exercise machines are designed for use in areas that are smaller than a traditional gym, for example, a home or apartment. With these reduced areas, it has become increasingly important to conserve space by reducing the size of exercise machines. This reduced area arrangement for exercise machines is accomplished by providing multiple cable and pulley arrangements that are operable independent of one another. Conventional cable and pulley arrangements incorporate a fixed mechanical advantage that is predetermined by the number and position of the pulleys in the system.

Using these conventional cable and pulley arrangements, the user is limited to changing resistance levels in fixed increments determined by how much each weight of the weight stack weighs. For example, if the cable and pulley system allows for a 2:1 ratio and each weight plate in the weight stack weighs 20 pounds, the user can change the resistance only in 10 pound increments. For an exerciser to increase the resistance by less than a full 10 pounds, for example by 5 pounds, the user must add further weight to the stack, which are often in the form of a smaller weight to attach to the weight stack.

Other exercise machines have been developed that allow for a plurality of weight ratios. In particular, a cable and pulley arrangement including two floating pulleys that allow for an exercise machine to contain multiple exercise stations having varying mechanical advantage ratios have been developed. Devices using this type of arrangement, however, typically require the use of different exercise stations to vary the weight ratio. Due to the need to change exercise stations, the ability of the user to choose a varied weight ratio while exercising at the same station is not provided. A weight ratio arrangement may affect the cable pull and weight ratio together. Some user exercises need short travel and a heavy load, while other user exercises need long travel and a light load. Therefore, having an effective conversion mechanism on the same exercise machine could reduce the amount of exercise machines needed to perform the various user exercises.

SUMMARY OF THE INVENTION

According to one non-limiting embodiment of the present disclosure, an exercise machine may include a support frame, at least one weight rack configured to receive added weight, a locking mechanism movable between a locked position in which only one movable pulley block is movable and an unlocked position in which the two movable pulley blocks are movable, and a weight ratio arrangement engaged with the support frame, the at least one weight rack, and a first attachment extending from the support frame, the weight ratio arrangement may include an exercise cable having a first end and a second end, the first end being connected to the first attachment and the second end being connected to a portion of the exercise machine, and at least two movable pulley blocks, each movable pulley block including at least one pulley, wherein the at least one weight rack is attached to and configured to move with one of the at least two movable pulley blocks. The exercise cable may be a cable operatively connected to the at least two movable pulley blocks.

According to another non-limiting embodiment of the present disclosure, the at least two movable pulley blocks may include a first movable pulley block and a second movable pulley block, the at least one weight rack may be attached to and configured to move with the first movable pulley block, and the first movable pulley block may be disposed vertically above the second movable pulley block. The second movable pulley block may be configured to be locked by the locking mechanism between a locked position in which only the first movable pulley block is movable and an unlocked position in which the first and the second movable pulley blocks are movable.

According to another non-limiting embodiment of the present disclosure, at least two throughholes may include a first through hole and a second throughhole provided on the support frame and a third throughhole provided on one of the at least two movable pulley blocks, and the third throughhole may be aligned between the first and the second throughholes in the locked position. The at least one pulley may be positioned on the support frame adjacent to the first attachment, and the at least one pulley may be configured to direct the exercise cable in a downward or upward direction. The at least one pulley may be slidably mounted on the support frame and movable in a vertical direction on the support frame. At least one guide rod may be attached to the support frame, and the at least two movable pulley blocks may be configured to move in a vertical direction along the at least one guide rod.

According to another non-limiting embodiment of the present disclosure, a stop member may be positioned between the at least two movable pulley blocks to prevent the at least two movable pulley blocks from contacting one another. At least one floating pulley may be operatively connected to the exercise cable. A second attachment and a pull-down cable may have a first end and a second end, the first end being connected to the second attachment and the second end being connected to the at least one floating pulley. At least one pull-down pulley may be positioned on the support frame adjacent to the second attachment, and the at least one pull-down pulley may be configured to direct the pull-down cable downward. A weight stack arrangement may be with the support frame, including an adjustable weight stack and a weight stack cable which may have a first end and a second end, the first end may be connected to the adjustable weight stack and the second end may be connected to the at least one movable pulley block. The weight stack arrangement may include at least one weight stack pulley configured to direct the weight stack cable from the adjustable weight stack to the at least one movable pulley block.

According to another non-limiting embodiment of the present disclosure, a cable and pulley arrangement for an exercise machine may include a weight ratio pulley arrangement engaged with a support frame, the weight ratio arrangement may include a first exercise handle, a second exercise handle, at least one weight rack configured to adjustably receive added weight, and a weight ratio arrangement engaged with the support frame, the at least one weight rack, the first exercise handle, and the second exercise handle, the weight ratio arrangement may include first exercise cable having a first end and a second end, the first end being connected to the first exercise handle and the second end being connected to a portion of the exercise machine, two movable pulley blocks, each movable pulley block including at least one pulley, wherein the at least one weight rack is configured to move with one of the at least two movable pulley blocks, a locking mechanism movable between a locked position in which only one movable pulley block is movable and an unlocked position in which the two movable pulley blocks are movable, at least one floating pulley, and a second exercise cable having a first end and a second end, the first end being connected to the second exercise handle and the second end being connected to the at least one floating pulley.

According to another non-limiting embodiment of the present disclosure, the first exercise cable may be operatively connected to a first movable pulley block of the at least two movable pulley blocks, the first exercise cable may be operatively connected to a second movable pulley block of the at least two movable pulley blocks, the first exercise cable may be operatively connected to the at least one floating pulley, and the second movable pulley block is prevented from moving when the locking mechanism is in the locked position. The locking mechanism may include a pin and at least two through holes configured to receive the pin therethrough, at least one throughhole may be provided on the support frame and at least one throughhole is provided the second movable pulley block, and the pin may be slidably received through the at least two throughholes in the locked position.

According to another non-limiting embodiment of the present disclosure, at least one guide rod may be attached to the support frame, and the at least two movable pulley blocks may be configured to move in a vertical direction along the at least one guide rod. The at least one weight rack may be configured to receive plated weights thereon. The at least one weight rack may be a weight stack arrangement including and adjustable weight stack and a weight stack cable having a first end and a second end, the first end connected to the adjustable weight stack and the second end connected to the at least one movable pulley block.

The present disclosure may be further defined by the following clauses:

Clause 1. An exercise machine comprising: a support frame; at least one weight rack configured to receive added weight; a weight ratio arrangement engaged with the support frame, the at least one weight rack, and a first attachment extending from the support frame, the weight ratio arrangement comprising: an exercise cable having a first end and a second end, the first end being connected to the first attachment and the second end being connected to a portion of the exercise machine; and at least two movable pulley blocks, each movable pulley block including at least one pulley, wherein the at least one weight rack is attached to and configured to move with one of the at least two movable pulley blocks; and a locking mechanism movable between a locked position in which only one movable pulley block is movable and an unlocked position in which the two movable pulley blocks are movable, wherein the exercise cable is cable is operatively connected to the at least two movable pulley blocks.

Clause 2. The exercise machine of clause 1, wherein the at least two movable pulley blocks comprises a first movable pulley block and a second movable pulley block, wherein the at least one weight rack is attached to and configured to move with the first movable pulley, and wherein the first movable pulley block is disposed vertically above the second movable pulley block.

Clause 3. The exercise machine of clause 1 or 2, wherein the second movable pulley block is configured to be locked by the locking mechanism between a locked position in which only the first movable pulley block is movable and an unlocked position in which the first and the second movable pulley blocks are movable.

Clause 4. The exercise machine of any of clauses 1-3, wherein the locking mechanism comprises a pin and at least two through holes configured to receive the pin therethrough, wherein at least one throughhole is provided on the support frame and at least one throughhole is provided on one of the at least two movable pulley blocks, and wherein the pin is slidably received through the at least two throughholes in the locked position.

Clause 5. The exercise machine of any of clauses 1-4, wherein at least two throughholes comprise a first through hole and a second throughhole provided on the support frame and a third throughhole provided on one of the at least two movable pulley blocks, and wherein the third throughhole is aligned between the first and the second throughholes in the locked position.

Clause 6. The exercise machine of any of clauses 1-5, further comprising at least one pulley positioned on the support frame adjacent to the first attachment, wherein the at least one pulley is configured to direct the exercise cable in a downward or upward direction.

Clause 7. The exercise machine of any of clauses 1-6, wherein the at least one pulley is slidably mounted on the support frame and movable in a vertical direction on the support frame.

Clause 8. The exercise machine of any of clauses 1-7, further comprising at least one guide rod attached to the support frame, wherein the at least two movable pulley blocks are configured to move in a vertical direction along the at least one guide rod Clause 9. The exercise machine of any of clauses 1-8, further comprising a stop member positioned between the at least two movable pulley blocks to prevent the at least two movable pulley blocks from contacting one another.

Clause 10. The exercise machine of any of clauses 1-9, further comprising at least one floating pulley operatively connected to the exercise cable.

Clause 11. The exercise machine of any of clauses 1-10, further comprising a second attachment and a pull-down cable having a first end and a second end, the first end being connected to the second attachment and the second end being connected to the at least one floating pulley.

Clause 12. The exercise machine of any of clauses 1-11, further comprising at least one pull-down pulley positioned on the support frame adjacent to the second attachment, wherein the at least one pull-down pulley is configured to direct the pull-down cable downward.

Clause 13. The exercise machine of any of clauses 1-12, further comprising a weight stack arrangement engaged with the support frame comprising: an adjustable weight stack; and a weight stack cable having a first end and a second end, the first end connected to the adjustable weight stack and the second end connected to the at least one movable pulley block.

Clause 14. The exercise machine of any of clauses 1-13, wherein the weight stack arrangement further comprises at least one weight stack pulley configured to direct the weight stack cable from the adjustable weight stack to the at least one movable pulley block.

Clause 15. A cable and pulley arrangement for an exercise machine, comprising: a weight ratio pulley arrangement engaged with a support frame, the weight ratio arrangement comprising: a first exercise handle; a second exercise handle; at least one weight rack configured to adjustably receive added weight; and a weight ratio arrangement engaged with the support frame, the at least one weight rack, the first exercise handle, and the second exercise handle, the weight ratio arrangement comprising: a first exercise cable having a first end and a second end, the first end being connected to the first exercise handle and the second end being connected to a portion of the exercise machine; two movable pulley blocks, each movable pulley block including at least one pulley, wherein the at least one weight rack is configured to move with one of the at least two movable pulley blocks; a locking mechanism movable between a locked position in which only one movable pulley block is movable and an unlocked position in which the two movable pulley blocks are movable, at least one floating pulley; and a second exercise cable having a first end and a second end, the first end being connected to the second exercise handle and the second end being connected to the at least one floating pulley.

Clause 16. The cable and pulley arrangement of clause 15, wherein the first exercise cable is operatively connected to a first movable pulley block of the at least two movable pulley blocks, wherein the first exercise cable is operatively connected to a second movable pulley block of the at least two movable pulley blocks, wherein the first exercise cable is operatively connected to the at least one floating pulley, and wherein the second movable pulley block is prevented from moving when the locking mechanism is in the locked position.

Clause 17. The cable and pulley arrangement of clause 15 or 16, wherein the locking mechanism comprises a pin and at least two through holes configured to receive the pin therethrough, wherein at least one throughhole is provided on the support frame and at least one throughhole is provided the second movable pulley block, and wherein the pin is slidably received through the at least two throughholes in the locked position.

Clause 18. The cable and pulley arrangement of any of clauses 15-17, further comprising at least one guide rod attached to the support frame, wherein the at least two movable pulley blocks are configured to move in a vertical direction along the at least one guide rod.

Clause 19. The cable and pulley arrangement of any of clauses 15-18, wherein the at least one weight rack is configured to receive plated weights thereon.

Clause 20. The cable and pulley arrangement of any of clauses 15-19, wherein the at least one weight rack is a weight stack arrangement comprising: an adjustable weight stack; and a weight stack cable having a first end and a second end, the first end connected to the adjustable weight stack and the second end connected to the at least one movable pulley block.

DESCRIPTION OF THE DISCLOSURE

For purposes of the description hereinafter, the terms "upper", "lower", "right", "left", "vertical", "horizontal", "top", "bottom", "lateral", "longitudinal", and derivatives thereof shall relate to the disclosure as it is oriented in the figures. However, it is to be understood that the disclosure may assume alternative variations and step sequences, except where expressly specified to the contrary. It is also to be understood that the specific devices and processes illustrated in the attached drawings, and described in the following specification, are simply exemplary aspects of the disclosure. Hence, specific dimensions and other physical characteristics related to the aspects disclosed herein are not to be considered as limiting.

The present disclosure is directed to, in general, an exercise or weight machine and, more particularly, to a weight ratio arrangement that allows a user to vary a mechanical advantage provided by traditional pulley arrangements on the exercise or weight machines. Certain aspects of the components of the exercise or weight machine and the weight ratio arrangement are illustrated in FIGS. 1-11

Figure 1:
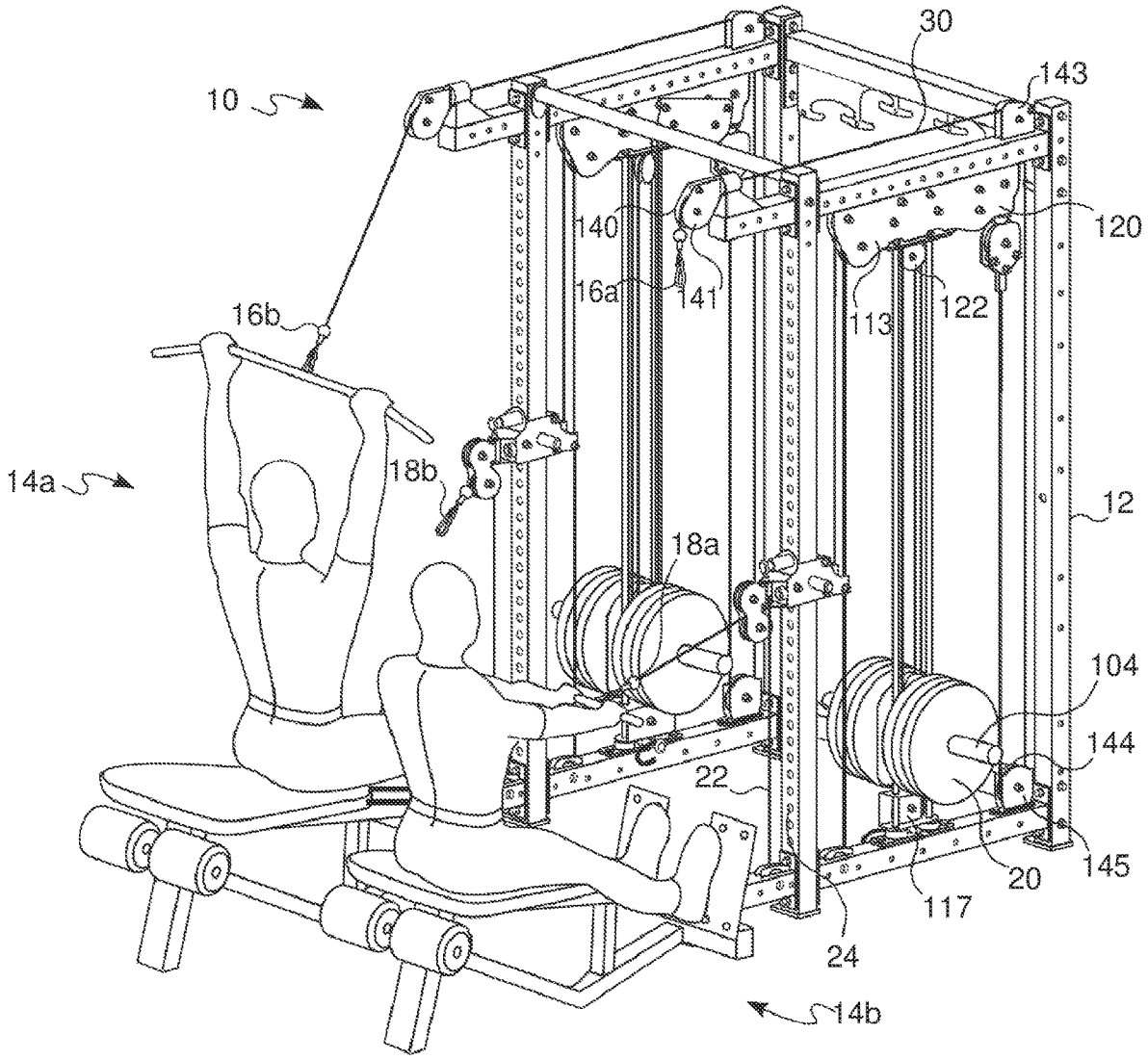
FIG. 1 is a perspective view of an exercise machine with a weight ratio arrangement applied to two high-low pulley column machines showing users using the exercise machine and the weight ratio arrangement in different exercise positions.

With reference to FIGS. 1, 2, 4, 6, and 11, a non-limiting embodiment of an exercise machine 10 (also referred to a weight machine or a weightlifting machine) that includes different exercise stations is shown. As shown in FIG. 1, the exercise machine 10 includes a support frame 12 that houses several different components of the exercise machine 10, including a first exercise station 14*a* and a second exercise station 14*b*. Each exercise station 14*a*, 14*b* may include a lat pull-down portion with a lat bar 16*a*, 16*b* and a row portion with exercise handles 18*a*, 18*b*. The user(s) may pull on the lat bars 16*a*, 16*b* and the exercise handles 18*a*, 18*b* to pull a load attached to the exercise machine 10 for exercising. Although only lat bars 16*a*, 16*b* and exercise handles 18*a*, 18*b* are shown, it is contemplated that other weight lifting handles, seats, and equipment may be used in conjunction with the exercise machine 10. For example, a user may sit on a bench in an inclined position and perform various exercises with the lat bars 16*a*, 16*b*, and/or the exercise handles 18*a*, 18*b* other than the exercises illustrated in FIG. 1.

Figure 11:
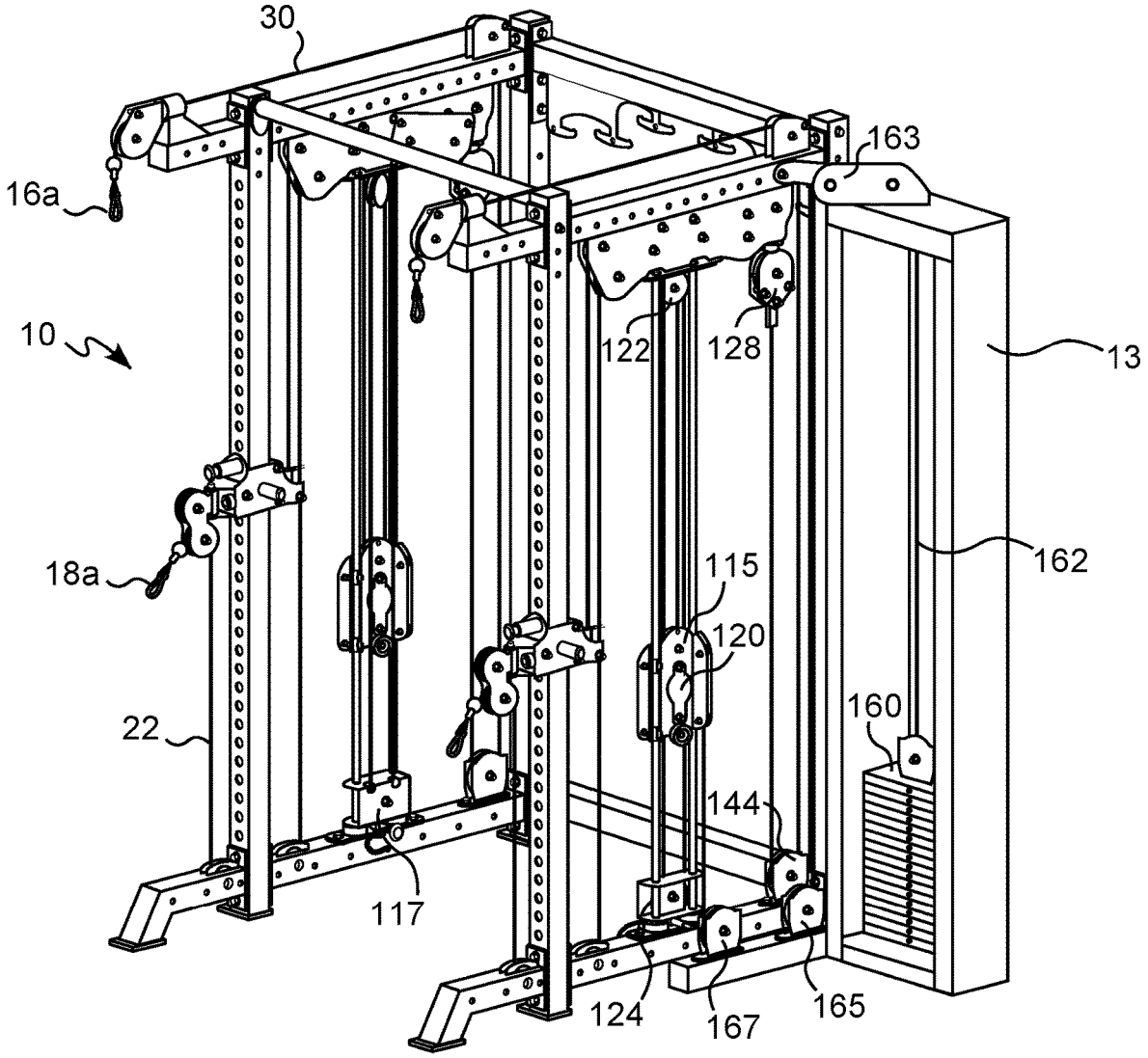
FIG. 11 is a perspective view of the exercise machine with a weight ratio arrangement of FIG. 1 coupled to a weight stack.

With continued reference to FIGS. 1, 2, 4, and 6, the load attached to the exercise machine 10 may be in the form of plated weights 20. The plated weights 20 may be slidably received on a first weight rack 102 and a second weight rack 104. Any number of plated weights 20 being any amount of weight may be added to the first and second weight racks 102, 104. As shown in FIG. 11 and discussed in more detail below, the load may also be in the form of a weight stack 130.

Figure 2:
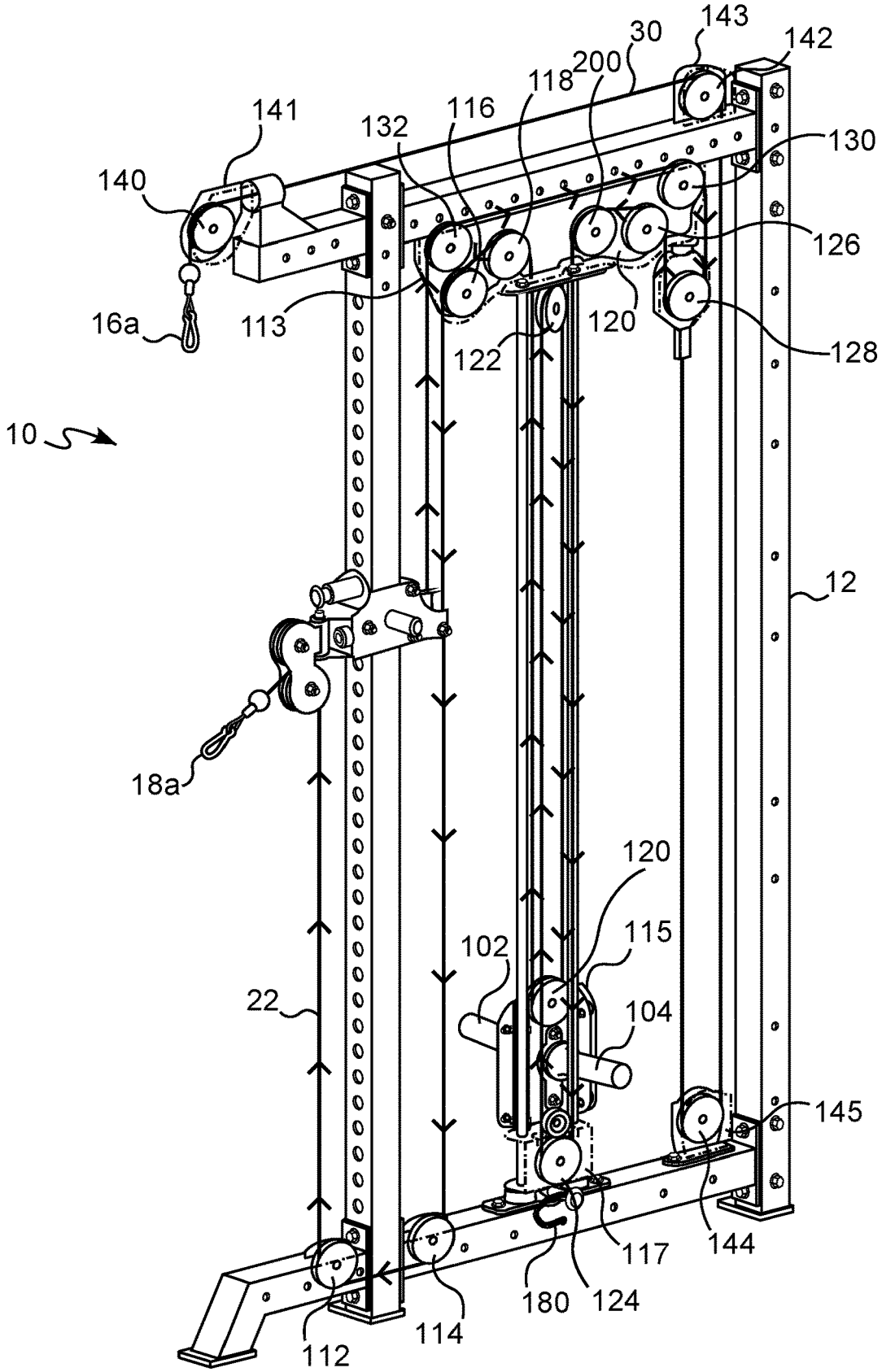
FIG. 2 is a perspective, partially-transparent view of one high-low pulley column machine of the exercise machine with a weight ratio arrangement applied thereto of FIG. 1.
Figure 3:
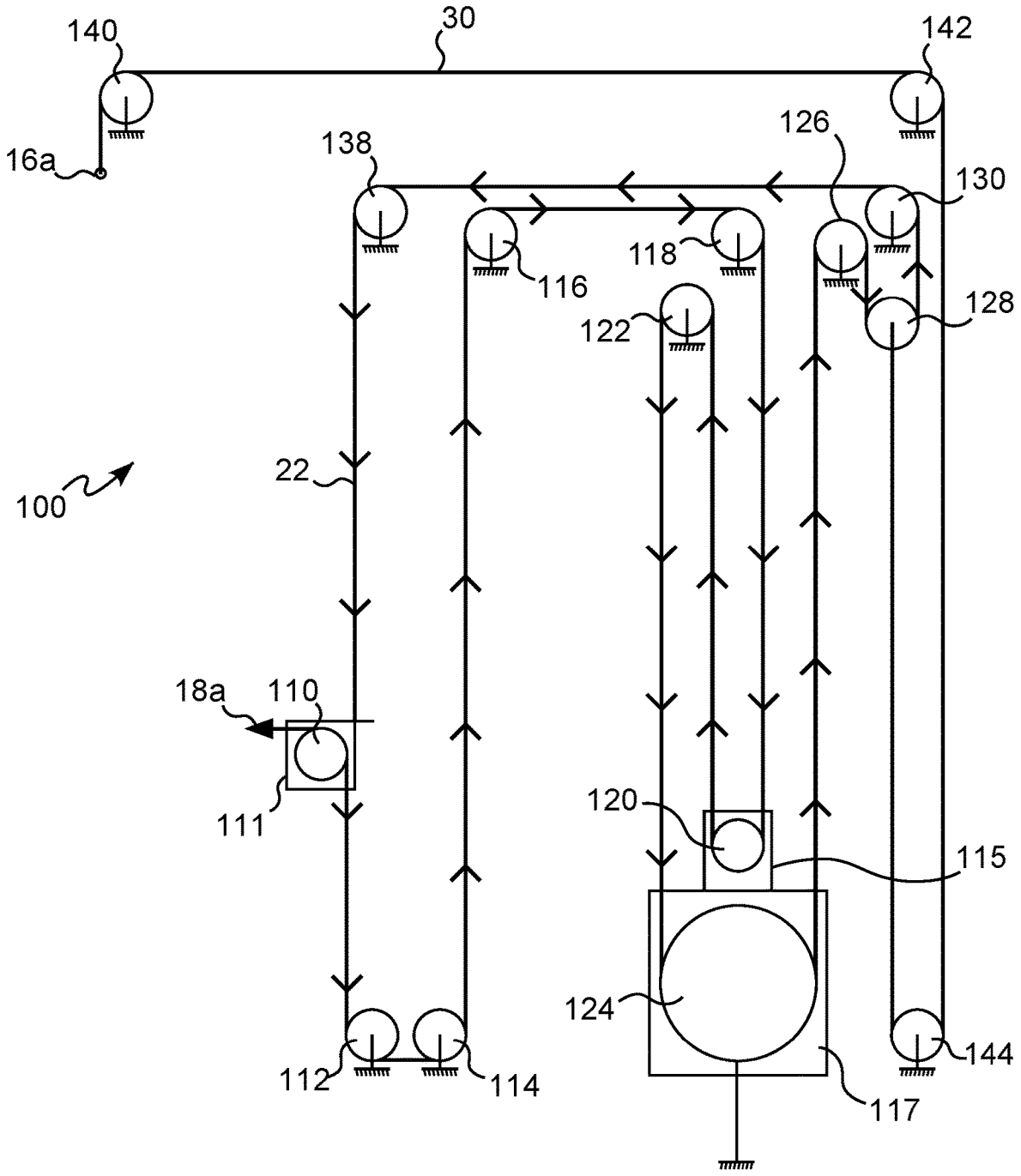
FIG. 3 is a schematic illustration of the weight ratio arrangement of the single high-low pulley column machine of FIG. 2.

With reference to FIGS. 2 and 3, a non-limiting embodiment of a weight ratio arrangement 100 for use in the exercise machine 10 is described. The weight ratio arrangement 100 is provided in the exercise machine 10 to provide resistance against a user's pulling force on the exercise handle 18*a* or lat bar 16*a*. The resistance from the weight ratio arrangement 100 is provided by the weight ratio arrangement's 100 connection to the first weight rack 102 and the second weight rack 104. First and second weight racks 102, 104 are located on the top movable pulley block 115. A user may add weights of various seizes to the first and second weight racks 102, 104 to obtain a desired resistance.

The weight ratio arrangement 100 includes an exercise cable 22 and a plurality of pulleys, as described in further detail below. A first end of the exercise cable 22 is connected to the exercise handle 18*a*. A second opposing end of the exercise cable 22 is connected to a pulley block 111 provided on support frame 12 of the exercise machine 10. As shown in FIGS. 2 and 3, the exercise cable 22 extends from the exercise handle 18*a* through the pulley block 111 that includes the pulley 110. The pulley block 111 may be vertically adjusted on the support frame 12 into different positions to perform different exercises for users of varying heights. The pulley block 111 may slide along the support frame 12 and engage with various portions of the support frame 12 in order to be vertically adjusted, or the pulley block 111 may include a slidable pin or removable locking mechanism 24 that is received within one or more holes 26 (only one numbered for clarity) in order to be adjusted vertically along the support frame 12.

With the first end of the exercise cable 22 connected to the exercise handle 18*a* and the second end of the exercise cable 22 connected to the adjustable pulley block 111, the exercise cable 22 also adjusts its position relative to the support frame 12 with pulley block 111 as pulley block 111 is vertically adjusted. It is contemplated that the second end of the exercise cable 22 may be attached to other portions of the support frame 12. In such instances, pulley block 111 may be fixed to a portion of the support frame 12 in order to keep the exercise cable 22 properly routed within the weight ratio arrangement 100.

The exercise cable 22 is guided through the pulley 108 downwardly to a pulley 112 fixed to a bottom portion of the support frame 12. The exercise cable 22 is directed through another pulley 114 also fixed to a bottom portion of the support frame 12. The exercise cable 22 is then directed upwards to pulley block 113 fixed to an upper portion of the support frame 12. Within pulley block 113, the exercise cable 22 is directed through a pulley 116 and further directed through a pulley 118. It is contemplated that pulley 114 may be located upwards within pulley block 113 instead of downwards in a bottom portion of the support frame 12. Either configuration may be appropriate for the weight ratio arrangement 100.

The exercise cable 22 is then directed downward to the top movable pulley block 115. The exercise cable 22 is directed through a pulley 120 in the top movable pulley block 115 and upwards to another pulley 122 attached to pulley block 113. Although not shown, it is contemplated that pulley 122 may be within pulley block 113, attached to a pulley block 119, or within pulley block 119 so as to maintain proper spacing between the multiple pulleys described herein, so the weight ratio arrangement 100 operates properly.

After being directed through pulley 120 and top movable pulley block 115, the exercise cable 22 is again directed downward to a bottom movable pulley block 117 and a pulley 124 located therein. Bottom movable pulley block 117 and pulley 124 are shown as being larger than top movable pulley block 115 and pulley 120 for clarity purposes in FIGS. 3, 5, 7, and 10. Bottom movable pulley block 117 and pulley 124 may be any size relative to top movable pulley block 115 and pulley 120 in practice. Top movable pulley block 115 and bottom movable pulley block 117 are both movable along a first pole 150 and a second pole 152. Both first and second poles 150, 152 are mounted to a bottom portion and a top portion of the support frame 12 and portions of the top movable pulley block 115 and bottom movable pulley block 117 may receive the first and second poles 150, 152 thereon in order to facilitate the movement of each.

The exercise cable 22 is then directed upwards from pulley 124 and towards pulley block 119 where it is then directed through pulley 126 located therein. As shown in FIG. 2, the exercise cable 22 may also be directed through pulley 200 also located within pulley block 119, however pulley 200 may only serve to organize the exercise cable 22 within the exercise machine 10 and may or may not be needed depending on the configuration of the other pulleys within the exercise machine 10. The exercise cable 22 is directed downwards through a floating pulley 128 before being direct upwards again to pulley 130 also located within pulley block 119. The exercise cable 22 is directed to pulley 132 housed in pulley block 113 and downward to be fixed to the pulley block 111. As shown in FIGS. 1, 2, 4, 6, and 11, pulley block 113 and pulley block 119 are two halves of a pulley block unit, however it is contemplated that they may be completely separate pulley blocks used for housing their respective pulleys.

In the configuration described above, the exercise cable 22 interacts with bottom movable pulley block 117 and pulley 124 to change the weight ratio of the weight ratio arrangement 100. Depending on which handle is used, either the lat bar 16*a* or exercise handle 18*a*, and whether or not the bottom movable pulley block 117 is in the locked or unlocked position, the user may experience a 1:1, 1:2, or 1:4 weight ratio. Each of these scenarios will be described in more detail below. As the weight ratio of the weight ratio arrangement 100 changes, the user of the exercise machine 10 can experience three different resistance levels with the same amount of weight applied to the first and second weight racks 102, 104. This is made possible by the mechanical advantage provided by the pulley system of the weight ratio arrangement 100. As the number of movable pulleys changes, so too does the amount of resistance experienced by a user of the exercise machine 10.

Figure 4:
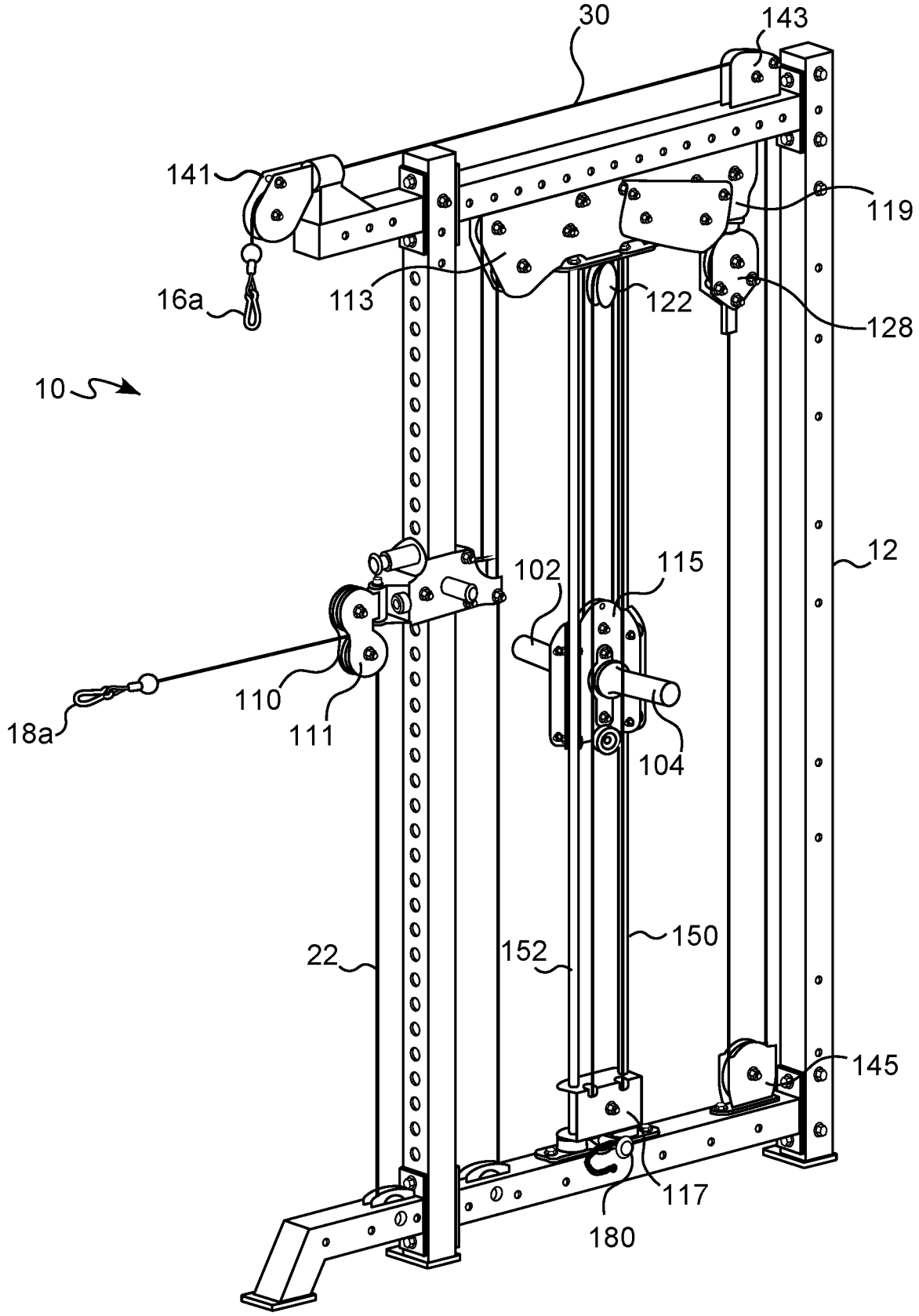
FIG. 4 is a perspective view of the one high-low pulley column machine of FIG. 2 with the weight ratio arrangement in a 1:1 and 1:2 weight ratio configuration.
Figure 5:
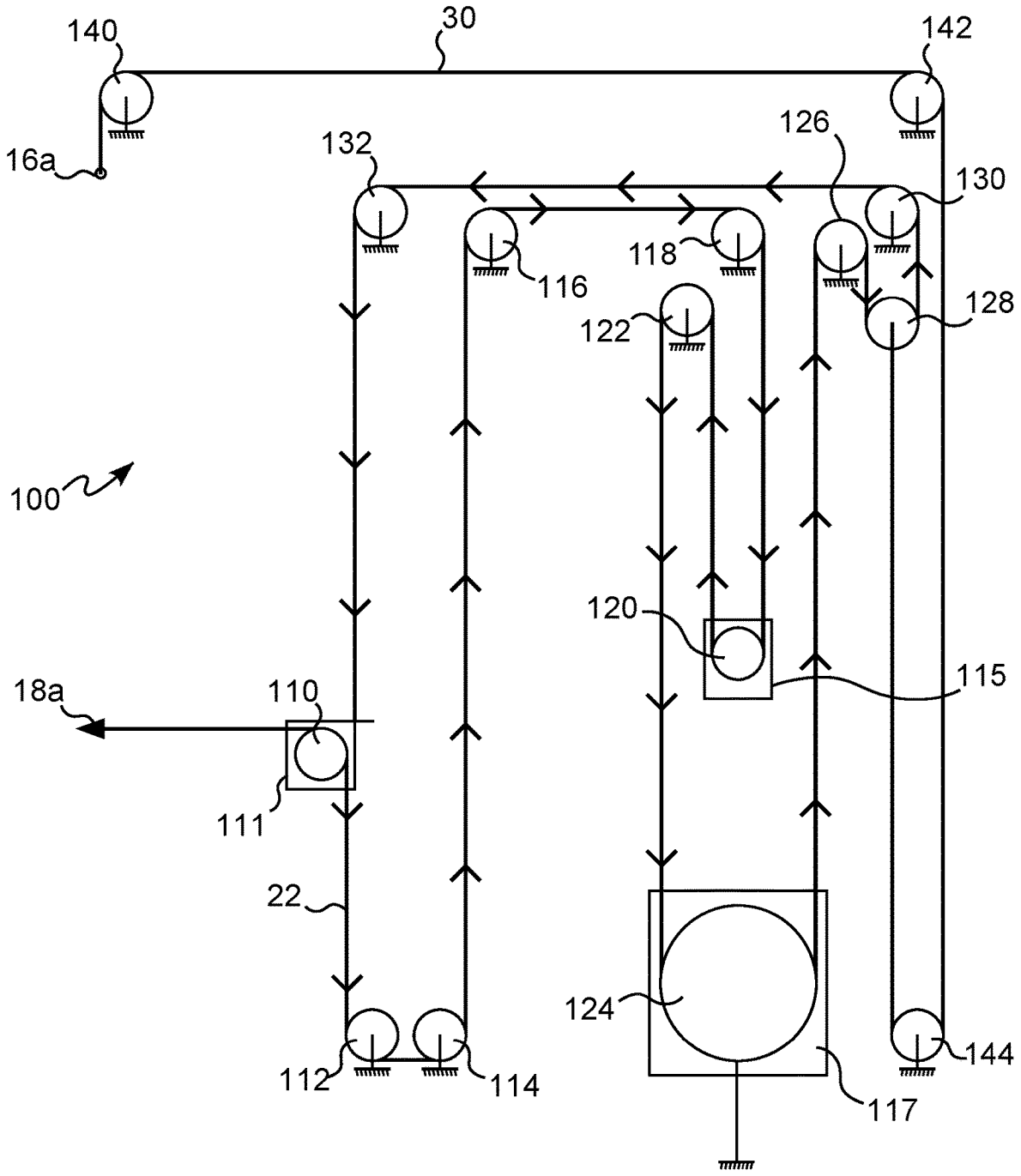
FIG. 5 is a schematic illustration of the weight ratio arrangement of the single high-low pulley column machine of FIG. 4 with the weight ratio arrangement in a 1:1 and 1:2 weight ratio configuration.
Figure 8:
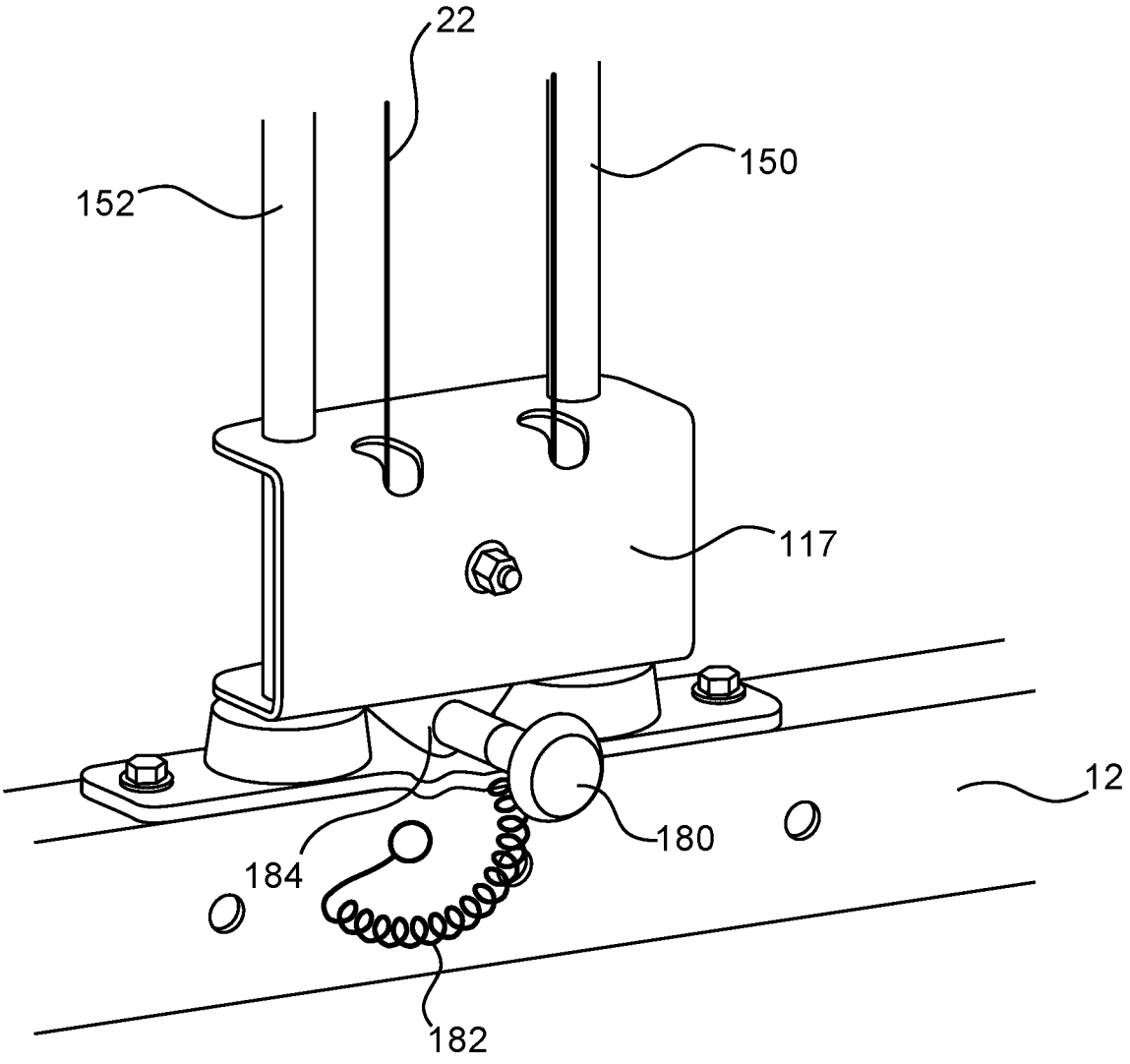
FIG. 8 a perspective view of a pulley block locking mechanism in a locked position.

Referring now to FIGS. 4, 5, and 8 the bottom movable pulley block 117 is in the locked position. In the locked position, the bottom movable pulley block 117 and pulley 124 have no bearing on the weight ratio of the weight ratio arrangement 100. As a user pulls on exercise handle 18*a*, the bottom movable pulley block 117 remains connected to the support frame 12 while only the top movable pulley block 115 moves along the first and second poles 150, 152. By pulling the exercise handle 18*a*, the user also pulls the exercise cable 22 which in turn pulls pulley 120 of the top movable pulley block 115 upwards. In the locked position, the weight ratio arrangement 100 is set at a 1:2 weight ratio for the exercise handle 18*a*. This means that the top movable pulley block 115, the weight racks 102, 104, and any plated weights 20 on the weight racks 102, 104 move up the poles 150, 152 half the distance that the user pulls the exercise handle 18*a*. For example, if the user were to pull the exercise handle 18*a* sixteen (16) inches away from the support frame 12, the top movable pulley block 115, the weight racks 102, 104, and any plated weight 20 would only move up the poles 150, 152 eight (8) inches. In other words, when the weight ratio arrangement 100 is set at a 1:2 weight ratio, a user exercising will displace the exercise handle 18*a* a distance twice as much as the weight racks 102, 104 and their associated plated weights 20 are displaced.

Figure 6:
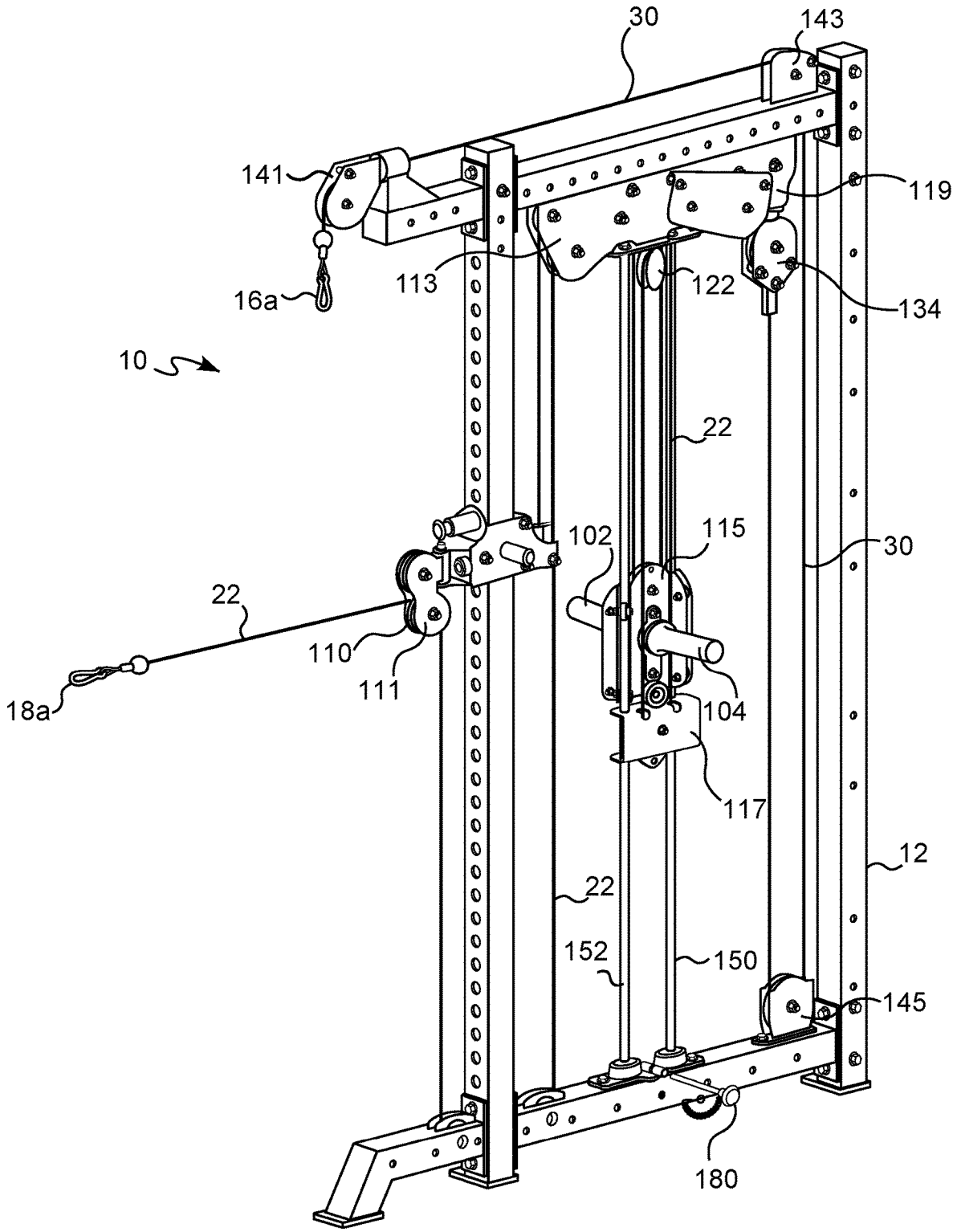
FIG. 6 is a perspective view of the one high-low pulley column machine of FIG. 2 with the weight ratio arrangement in a 1:2 and 1:4 weight ratio configuration.
Figure 7:
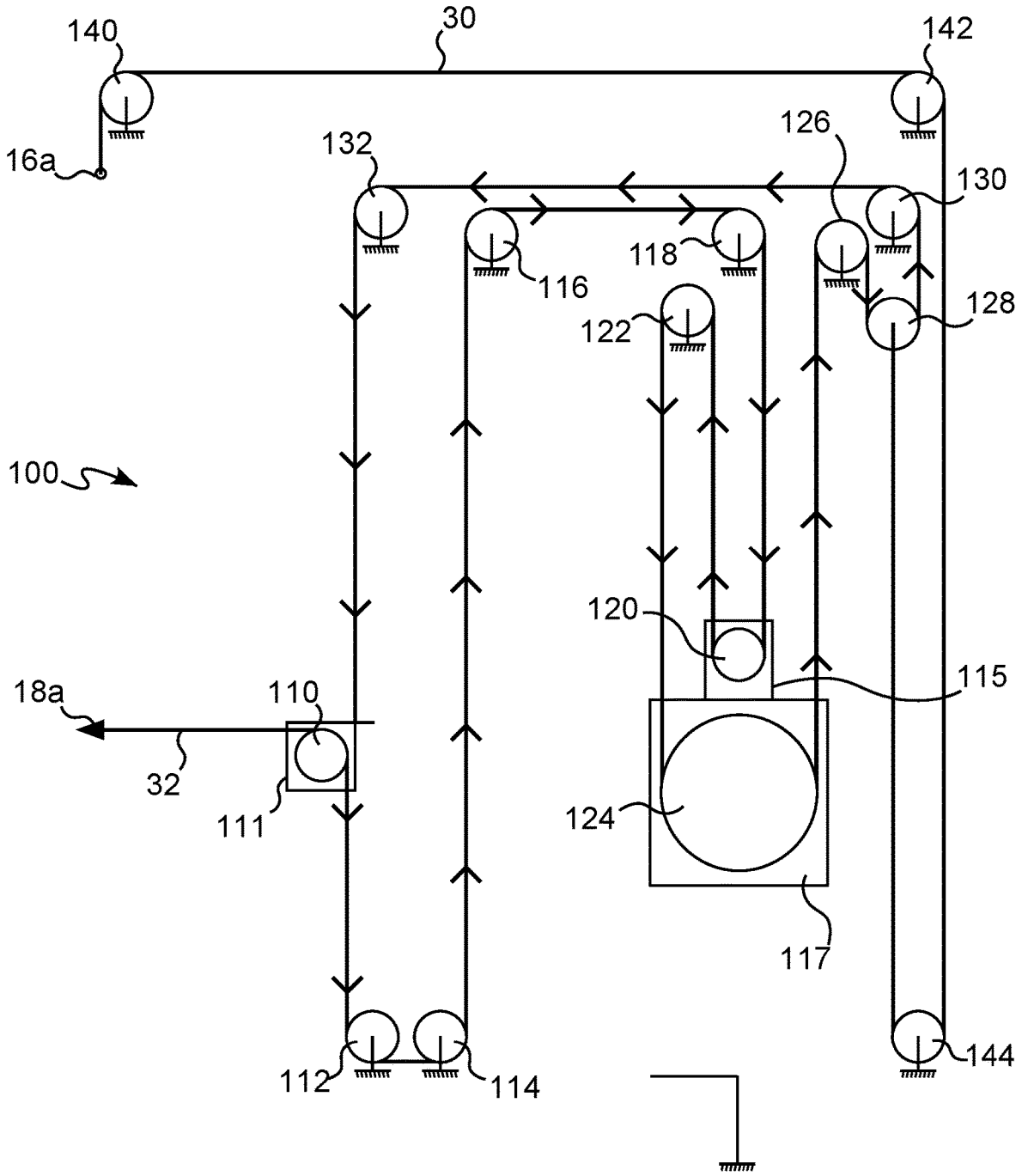
FIG. 7 is a schematic illustration of the weight ratio arrangement of the single high-low pulley column machine of FIG. 6 with the weight ratio arrangement in a 1:2 and 1:4 weight ratio configuration.
Figure 9:
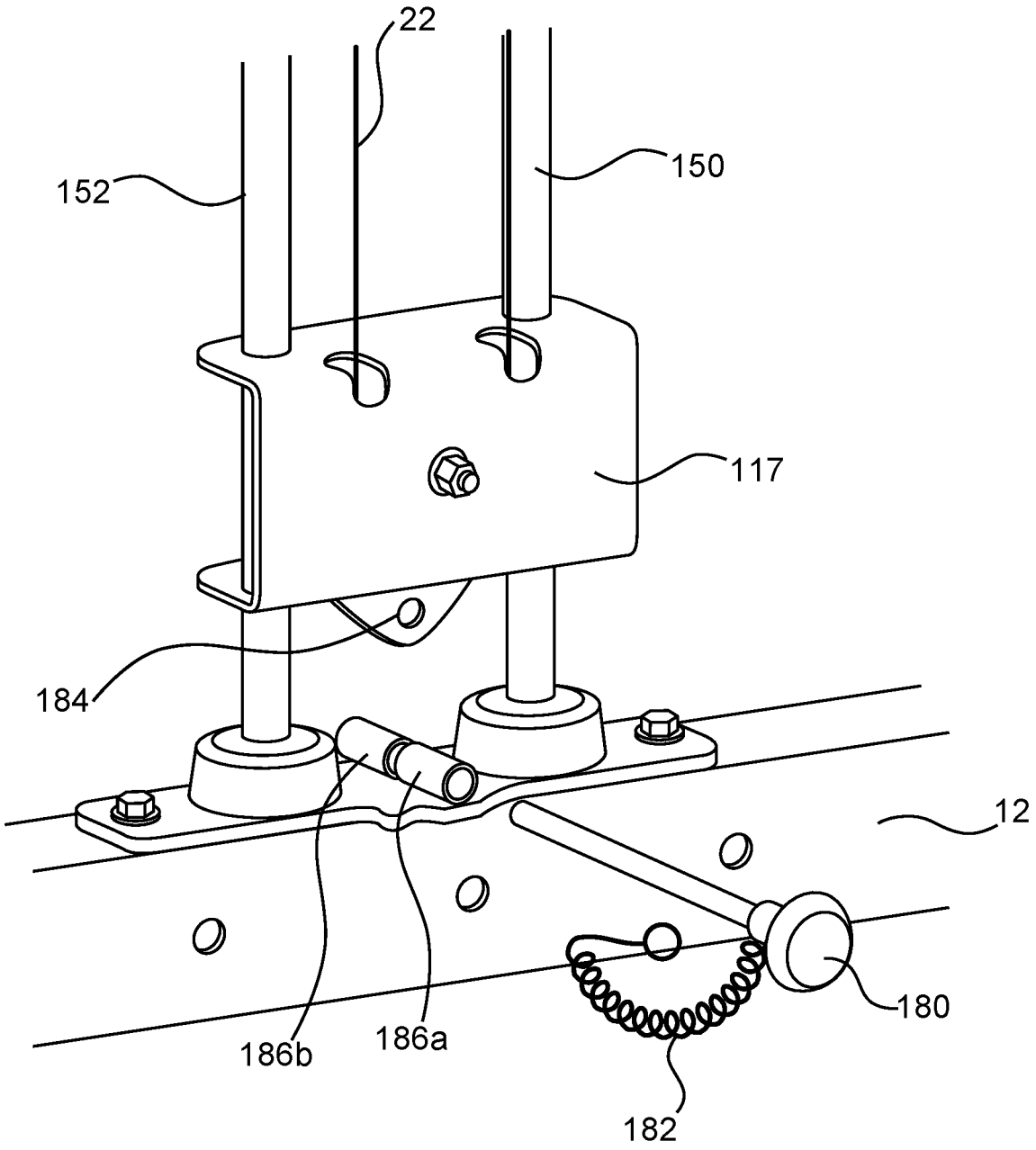
FIG. 9 is a perspective view of a pulley block locking mechanism in an unlocked position.

Referring now to FIGS. 6, 7, and 9, the bottom movable pulley block 117 is in the unlocked position. In the unlocked position, the bottom movable pulley block 117 and pulley 124 changes the weight ratio of the weight ratio arrangement 100 from a 1:2 weight ratio to a 1:4 weight ratio for exercise handle 18*a*. As a user pulls on exercise handle 18*a* both the top movable pulley block 115 and bottom movable pulley 117 move along the first and second poles 150, 152. By pulling the exercise handle 18*a*, the user also pulls the exercise cable 22 which now pulls pulley 120 and pulley 124 upwards moving the top movable pulley block 115 and bottom movable pulley block 117 upwards as well. As is with the locked position, the weight racks 102, 104 and any plated weights 20 thereon also move with the top movable pulley block 115. Because the exercise cable 22 moves both the top movable pulley block 115 and the bottom movable pulley block 117 upwards, the user experiences the 1:4 weight ratio mentioned above. This means if the user were to pull the exercise handle 18*a* sixteen (16) inches away from the support frame 12, the top movable pulley block 115 and the bottom movable pulley block 117 would only move upwards four (4) inches along the first and second poles 150, 152. In other words, when the weight ratio arrangement 100 is set at a 1:4 weight ratio, a user exercising will displace the exercise handle 18*a* a distance four times as much as the weight racks 102, 104 and their associated plated weights 20 are displaced. The varying distances required to pull the same amount of plated weights 20 depending on configuration of the weight ratio arrangement 100 allow a user to experience different exercise resistance with the same amount of equipment.

With further reference to FIGS. 1-7, an arrangement for a lat bar cable 30 and pulley system is described according to another non-limiting embodiment. One end of the lat bar cable 30 is connected to the lat bar 16*a* and an opposing second end of the lat bar cable 30 is fixed to the floating pulley 128. From the lat bar 16*a*, the lat bar cable 30 is directed over a first pulley 140 provided on an upper portion of the support frame 12 and over another pulley 142 provided on an opposing end of the support frame 12. Each pulley 140, 142 is housed within a pulley block 141, 143. The lat bar cable 30 is then directed downwards through a pulley 144 which is housed within a pulley block 145. The lat bar cable 30 is then directed upwards where it is fixed to the floating pulley 128.

Because floating pulley 128 is also connected to the pulley and cable system that includes exercise handle 18*a* and exercise cable 22, as described above, the lat bar cable 30 and pulley system also encounters a resistance determined by the plated weight 20 added by a user to weight racks 102, 104 as well as the chosen weight ratio of the weight ratio arrangement 100. When bottom movable pulley block 117 is in a locked position, the bottom movable pulley block 117 has no bearing on the weight ratio of the machine. Because the lat bar cable 30 is connected to the floating pulley 128, a user pulling the lat bar 16*a* with bottom movable pulley block 117 in the locked position experiences a 1:1 weight ratio. For example, when a user pulls the lat bar 16*a* sixteen (16) inches away from the support frame 12, the lat bar cable 30 pulls the floating pulley 128 downwards sixteen (16) inches, which in turn pulls the exercise cable 22 causing pulley 120 to be pulled upwards thus moving the first movable pulley block 115 up the first and second poles 150, 152 sixteen (16) inches as well. In other words, when the weight ratio arrangement 100 is set at a 1:1 weight ratio, a user exercising will displace the lat bar 16*a* an equal distance relative to the weight racks 102, 104 and their associated plated weights 20.

In the unlocked position, a user pulling the lat bar 16*a* experiences a 1:2 weight ratio. In the unlocked position, both the first movable pulley block 115 and the second movable pulley block 117 are moved by their respective pulleys 120, 124 located therein. When the lat bar cable 30 moves the floating pulley 128 which in turn moves the exercise cable 22, the first movable pulley block 115 and the second movable pulley block 117 move up the first and second poles 150, 152 providing the 1:2 weight ratio. For example, when a user pulls the lat bar 16*a* sixteen (16) inches away from the support frame 12, the first movable pulley block 115, any plated weight 20 attached to the weight racks 102, 104, and the second movable pulley block 117 move up the first and second poles 150, 152 eight (8) inches.

Figure 12:
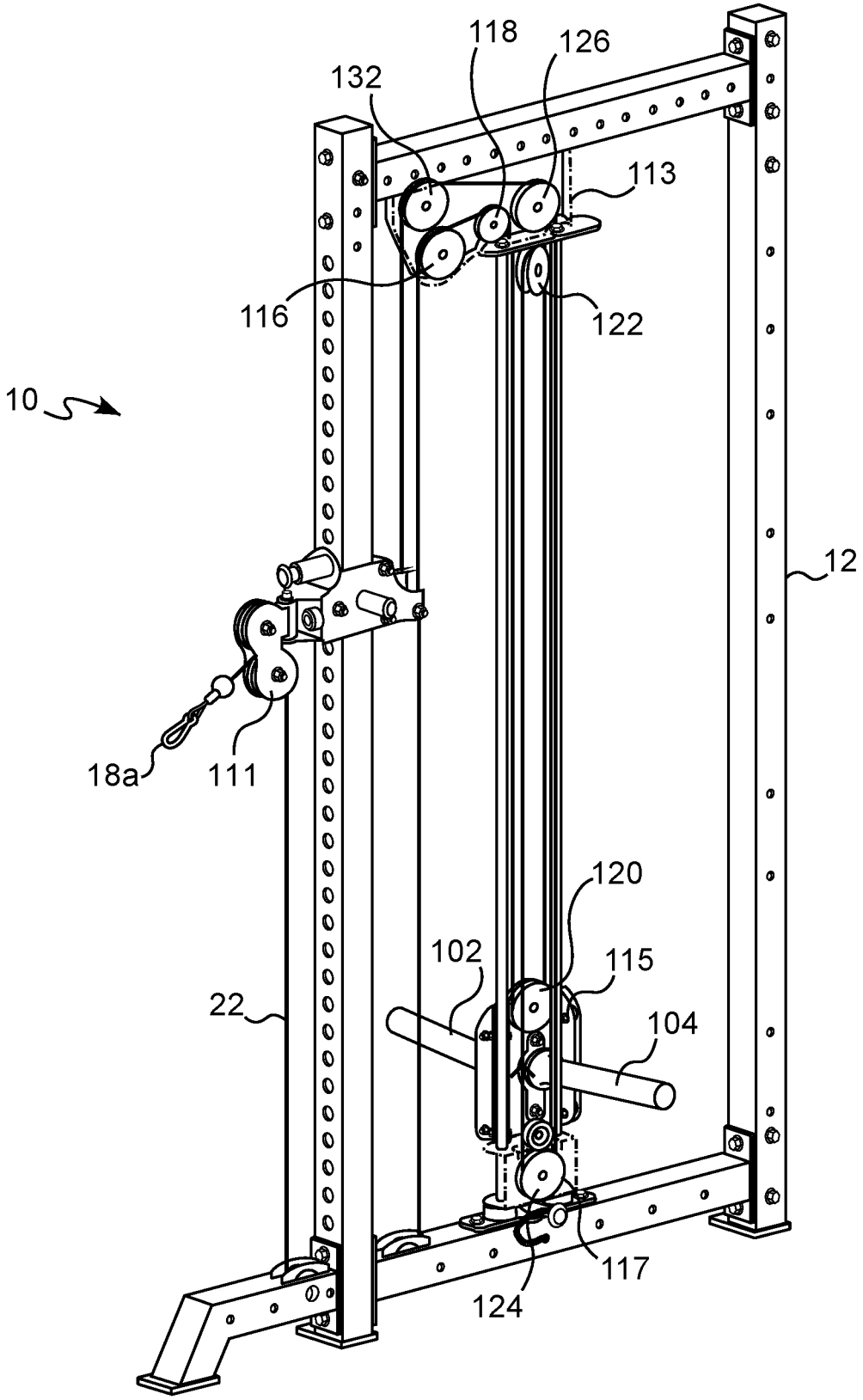
FIG. 12 is a perspective view of one high-low pulley column machine of the exercise machine in accordance with a non-limiting embodiment of the present disclosure.

With reference to FIG. 12, it is contemplated that the exercise machine 10 may not have lat bar 16*a*, lat bar cable 30, and their associated pulleys and pulley blocks attached to the support frame 12. With these elements removed from the exercise machine 10, only the exercise handle 18*a*, exercise cable 22, along with the necessary pulleys and pulley blocks required to maintain the weight ratio arrangement 100 described above are connected to the support frame 12. In other words, only the pulleys and pulley blocks required to provide the desired 1:2 or 1:4 weight ratio to an individual using exercise handle 18*a* may be attached to the support frame 12. Floating pulley 128 and pulley 130 are removed from the exercise machine 10. In such an arrangement, the routing of the exercise cable 22 from the exercise handle 18*a* through pulley 124 located within bottom movable pulley block 117 remains the same as described above. After being routed through pulley 124, exercise cable 22 is directed through pulley 126 where the exercise cable 22 is then routed across the support frame 12 to pulley 132. From pulley 132, the exercise cable 22 is directed downwardly to movable pulley block 111 where the second end of the exercise cable 22 may be attached. Pulleys 126, 132 may be housed in pulley block 113 along with pulleys 116, 118.

Referring now to FIGS. 8 and 9, the locking mechanism used to lock the bottom movable pulley block 117 will now be described. In the locked position, as shown in FIG. 8, locking pin 180 is inserted into receiving slots 184, 186. Receiving slot 184 is connected to the bottom movable pulley block 117 and receiving slots 186*a*, 186*b* is connected to the support frame 12. When in the locked position, the receiving slots 184, 186*a*, 186*b* align to accept locking pin 180. This configuration ensures the bottom movable pulley block 117 is connected to support frame 12 and is unable to move. In the unlocked position, as shown in FIG. 9, the locking pin 180 is removed from the receiving slots 184, 186 allowing the bottom movable pulley block 117 to move freely. In order to prevent the locking pin 180 from getting lost or misplaced, connector 182 may be provided to ensure the locking pin 180 remains connected to support frame 12. Any type of connector may be used so long as locking pin 180 is freely able to slide into and out of receiving slots 184, 186*a*, 186*b* and alter the weight ratio of the weight ratio arrangement 100.

Figure 10:
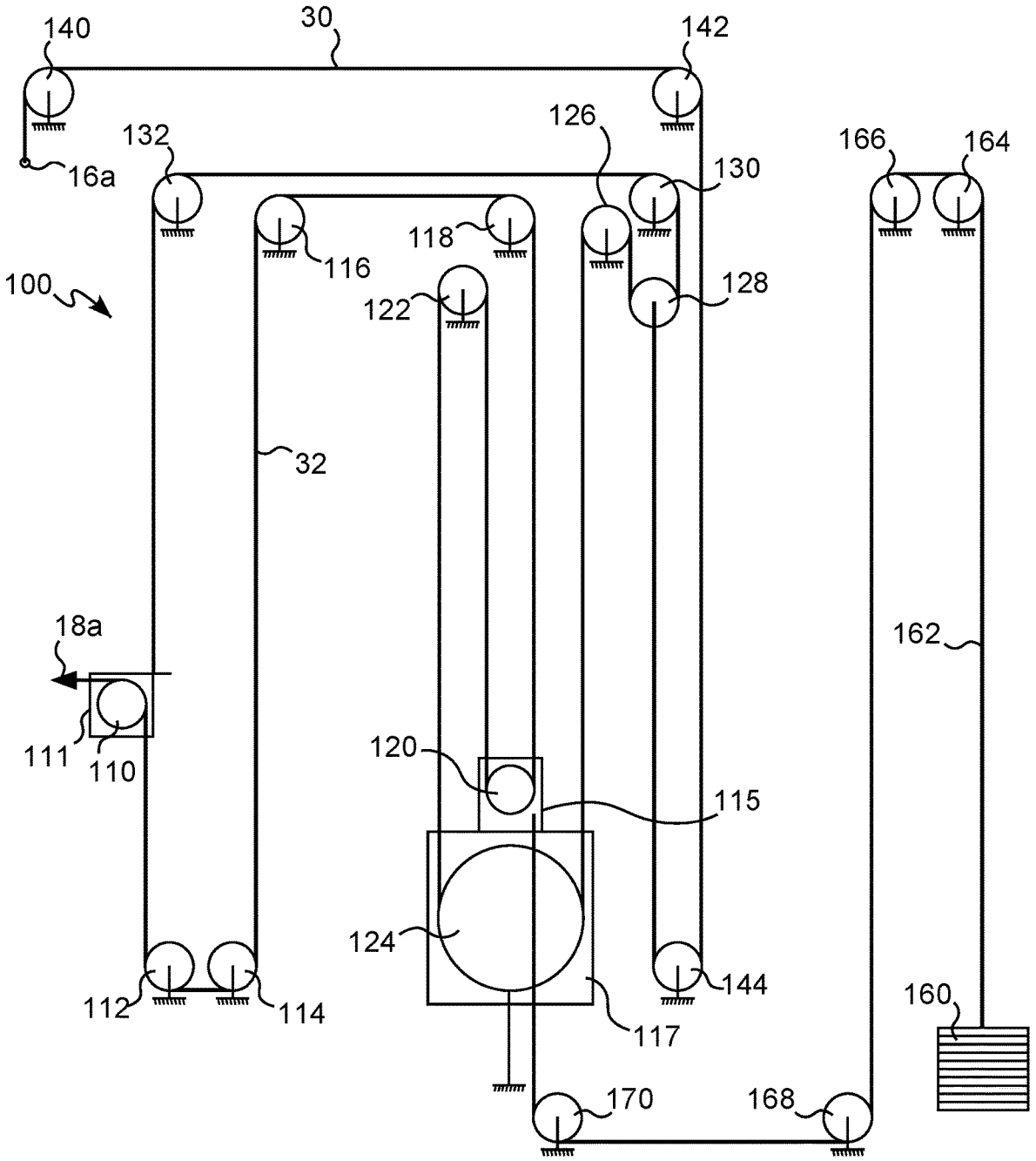
FIG. 10 is a schematic illustration of the weight ratio arrangement of FIG. 2, coupled to a weight stack.

Referring now to FIGS. 10 and 11, in a non-limiting embodiment of the present disclosure, a weight stack 160 be attached the above-described exercise machine 10 in order to provide a user resistance instead of the plated weights 20 located on the weight racks 102, 104. As shown in FIG. 10, a frame extension 13 may be used to house the weight stack 160 and other elements required to operate the weight stack 160 as will now be described. The attached weight stack 160 has a weight stack cable 162 with a first end fixed to the weight stack 160 and a second end fixed to the top movable pulley block 115 replacing the plated weights 20 and weight racks 102, 104. The weight stack cable 162 runs from the first end upward through pulley 164 and further directed through pulley 166. Both pulley 164 and pulley 166 are housed in pulley block 163. From there, the weight stack cable 162 is directed downwards to pulley 168 and continues to run through pulley 170 where it is directed upwards to the top movable pulley block 115. Pulley 168 is housed in pulley block 165 and pulley 170 is housed in pulley block 167. This embodiment has the same advantages as described above for both exercise handle 18*a* users and lat bar 16*a* users, the only difference being instead of a user adding a desired amount of resistance to the weight racks 102, 104, the user may choose a desired resistance from the weight stack 160. The user chooses the resistance provided by the weight stack by means known to those having skill in the art. For example, a locking mechanism such as a receiving pin may be adjusted along the weight stack 160 to select the desired amount of weight to be applied as a resistance to the exercise machine 10.

While various aspects of the exercise machines 10 and weight ratio arrangement 100 were provided in the foregoing description, those skilled in the art may make modifications and alterations to these aspects without departing from the scope and spirit of the invention. For example, it is to be understood that this disclosure contemplates that, to the extent possible, one or more features of any aspect can be combined with one or more features of any other aspect. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. An exercise machine, comprising:

a support frame;

at least one weight rack configured to receive added weight;

a weight ratio arrangement engaged with the support frame, the at least one weight rack, and a first attachment extending from the support frame, the weight ratio arrangement comprising:

an exercise cable having a first end and a second end, the first end being connected to the first attachment and the second end being connected to a portion of the exercise machine;

at least two movable pulley blocks aligned on a same axis of movement, each movable pulley block including at least one pulley, wherein the at least one weight rack is attached to and configured to move with one of the at least two movable pulley blocks; and a locking mechanism movable between a locked position in which only one movable pulley block is movable and an unlocked position in which the two movable pulley blocks are movable, wherein the exercise cable is operatively connected to the at least two movable pulley blocks.

2. The exercise machine of claim 1, wherein the at least two movable pulley blocks comprises a first movable pulley block and a second movable pulley block, wherein the at least one weight rack is attached to and configured to move with the first movable pulley, and wherein the first movable pulley block is disposed vertically above the second movable pulley block.

3. The exercise machine of claim 2, wherein the second movable pulley block is configured to be locked by the locking mechanism between a locked position in which only the first movable pulley block is movable and an unlocked positon in which the first and the second movable pulley blocks are movable.

4. The exercise machine of claim 1, wherein the locking mechanism comprises a pin and at least two through holes configured to receive the pin therethrough, wherein at least one through hole is provided on the support frame and at least one through hole is provided on one of the at least two movable pulley blocks, and wherein the pin is slidably received through the at least two through holes in the locked position.

5. The exercise machine of claim 4, wherein at least two through holes comprise a first through hole and a second throughhole provided on the support frame and a third through hole provided on one of the at least two movable pulley blocks, and wherein the third through hole is aligned between the first and the second through holes in the locked position.

6. The exercise machine of claim 1, further comprising at least one pulley positioned on the support frame adjacent to the first attachment, wherein the at least one pulley is configured to direct the exercise cable in a downward or upward direction.

7. The exercise machine of claim 6, wherein the at least one pulley is slidably mounted on the support frame and movable in a vertical direction on the support frame.

8. The exercise machine of claim 1, further comprising at least one guide rod attached to the support frame, wherein the at least two movable pulley blocks are configured to move in a vertical direction along the at least one guide rod.

9. The exercise machine of claim 1, further comprising a stop member positioned between the at least two movable pulley blocks to prevent the at least two movable pulley blocks from contacting one another.

10. The exercise machine of claim 1, further comprising at least one floating pulley operatively connected to the exercise cable.

11. The exercise machine of claim 10, further comprising a second attachment and a pull-down cable having a first end and a second end, the first end being connected to the second attachment and the second end being connected to the at least one floating pulley.

12. The exercise machine of claim 11, further comprising at least one pull-down pulley positioned on the support frame adjacent to the second attachment, wherein the at least one pull-down pulley is configured to direct the pull-down cable downward.

13. The exercise machine of claim 1, further comprising a weight stack arrangement engaged with the support frame comprising:

an adjustable weight stack; and a weight stack cable having a first end and a second end, the first end connected to the adjustable weight stack and the second end connected to the at least one movable pulley block.

14. The exercise machine of claim 13, wherein the weight stack arrangement further comprises at least one weight stack pulley configured to direct the weight stack cable from the adjustable weight stack to the at least one movable pulley block.

15. A cable and pulley arrangement for an exercise machine, comprising:

a weight ratio pulley arrangement engaged with a support frame, the weight ratio arrangement comprising:

a first exercise handle;

a second exercise handle;

at least one weight rack configured to adjustably receive added weight; and a weight ratio arrangement engaged with the support frame, the at least one weight rack, the first exercise handle, and the second exercise handle, the weight ratio arrangement comprising:

a first exercise cable having a first end and a second end, the first end being connected to the first exercise handle and the second end being connected to a portion of the exercise machine;

two movable pulley blocks aligned on a same axis of movement, each movable pulley block including at least one pulley, wherein the at least one weight rack is configured to move with one of the at least two movable pulley blocks;

a locking mechanism movable between a locked position in which only one movable pulley block is movable and an unlocked position in which the two movable pulley blocks are movable, at least one floating pulley; and a second exercise cable having a first end and a second end, the first end being connected to the second exercise handle and the second end being connected to the at least one floating pulley.

16. The cable and pulley arrangement of claim 15, wherein the first exercise cable is operatively connected to a first movable pulley block of the at least two movable pulley blocks, wherein the first exercise cable is operatively connected to a second movable pulley block of the at least two movable pulley blocks, wherein the first exercise cable is operatively connected to the at least one floating pulley, and wherein the second movable pulley block is prevented from moving when the locking mechanism is in the locked position.

17. The cable and pulley arrangement of claim 16, wherein the locking mechanism comprises a pin and at least two through holes configured to receive the pin therethrough, wherein at least one through hole is provided on the support frame and at least one through hole is provided on the second movable pulley block, and wherein the pin is slidably received through the at least two through holes in the locked position.

18. The cable and pulley arrangement of claim 15, further comprising at least one guide rod attached to the support frame, wherein the at least two movable pulley blocks are configured to move in a vertical direction along the at least one guide rod.

19. The cable and pulley arrangement of claim 15, wherein the at least one weight rack is configured to receive plated weights thereon.

20. The cable and pulley arrangement of claim 15, wherein the at least one weight rack is a weight stack arrangement comprising:

an adjustable weight stack; and a weight stack cable having a first end and a second end, the first end connected to the adjustable weight stack and the second end connected to the at least one movable pulley block.

* * * * *